US006630208B2

(12) United States Patent
Tokimasa et al.

(10) Patent No.: US 6,630,208 B2
(45) Date of Patent: Oct. 7, 2003

(54) USE OF SUBBING LAYER IN WEB COATING

(75) Inventors: Yasuhiko Tokimasa, Minami-Ashigara (JP); Yoshinobu Katagiri, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/050,585

(22) Filed: Jan. 18, 2002

(65) Prior Publication Data

US 2002/0132058 A1 Sep. 19, 2002

(30) Foreign Application Priority Data

Jan. 18, 2001 (JP) ..... 2001-010006

(51) Int. Cl.[7] ..... B05D 1/04; B05D 1/30

(52) U.S. Cl. ..... 427/471; 427/482; 427/420; 427/209; 427/210

(58) Field of Search ..... 427/471, 472, 427/482, 483, 420, 209, 210; 118/410

(56) References Cited

U.S. PATENT DOCUMENTS 4,826,703 A * 5/1989 Kisler
5,340,616 A * 8/1994 Amano et al.

FOREIGN PATENT DOCUMENTS

| | | |
|---|---|---|
| JP | 2747837 | 2/1998 |
| JP | 2835659 | 10/1998 |
| JP | 11-128804 | 5/1999 |

* cited by examiner

*Primary Examiner*—Fred J. Parker
(74) *Attorney, Agent, or Firm*—Young & Thompson

(57) ABSTRACT

A method to obtain and keep, at the time of actual coating, a uniform charge distribution on a web that is to be subsequently coated in order to establish stable high-speed coating provides a higher resistivity in a web edge area than that in a web central area by applying a subbing layer to the web central area while leaving the edge area free of the subbing layer.

19 Claims, 3 Drawing Sheets

USE OF SUBBING LAYER IN WEB COATING

FIELD OF THE INVENTION

This invention relates to a method for coating various liquid coating solutions onto electrified webs for use in the manufacture of photographic film materials, photographic paper, photographic printing materials, magnetic recording materials such as magnetic recording tape, adhesive tape, and information recording paper such as pressure-sensitive paper or thermal paper.

BACKGROUND OF THE INVENTION

Methods for coating webs are widely known where the surface of a continuously running web is electrified by some electrostatically charging device before a coating solution is applied, which is used in particular for realizing high-speed coating. In the coating methods using such electrified webs, a uniform charge distribution on the web is required. It is, however, not easy to give the charge-uniformity, especially in a lateral edge area of the web. Electrifying a web by a corona-discharging does not give a sufficient charging on the web in the edge area, which causes the coating to be unstable in that area.

To avoid such non-uniformity of charging of the web, Japanese patent No. 2,747,837 shows a method using a combination of grounding a web-transporting roller coated with ceramics by 0.3 to 0.5 mm thickness and a corona-discharging electrode having a width more than that of the web to extend it more than 10 mm in both sides. This method improves non-uniformity of charge for a moment, but still not enough at the time of actual coating. Japanese patent No. 2,835,659 presents another method where the web is electrified 0.5 to 2.0 KV in the surface potential after heated up to 35 to 45° C., but still non-uniformity remains in the edge area.

SUMMARY OF THE INVENTION

An object of the invention is to provide a method to obtain and keep a uniform charge distribution on a web that is to be subsequently coated in order to establish stable high-speed coating.

It was identified after some research that non-uniform charging is caused by not only non-uniformity in electrifying the web but also by leakage of charge from the web to transporting rollers at lateral edge areas of the web while the web is transported by contacting the rollers. An electrostatic charge on the electrified web leaks from one side surface when the one side contacts the roller. The amount of leakage depends on a surface resistivity of the web. That is, the lower the resistivity of the surface, the more the leakage from the surface. The leakage happens from a back surface (a surface usually not to be coated) in contact with the rollers, which in turn causes leakage from a front surface area (a surface normally to be coated).

Generally smaller surface resistivity is given to a back surface than to a front surface in order to avoid accumulation of electrostatic charge on the back surface which attracts various type of dust in the air. If some dust is attracted to the web and transferred to the surface of coating roller (web backing roller at a coating station), this causes coating defects and other defects. Thus, relatively lower surface resistivity of the back surface necessary to avoid dust related defects, leads to charge leakage from front surface, which tends to result in nonuniformity of charge on the front surface.

Based on the above, the following methods are provided. A method for coating a web comprises the steps of preparing a web of which at least one of both edge areas of the back surface has higher surface resistivity than a central area, advancing the web to pass by a coating station, electrifying the web upstream from the coating station; and coating the electrified web at the coating station. One of the ways to provide the web with at least one back surface edge area having higher surface resistivity than the central area is to apply a subbing layer to the web so as to leave the edge area unapplied.

DETAILED DESCRIPTION OF THE INVENTION EMBODIMENT

Supporting web:

In the invention, papers, plastic films, resin-coated papers and synthetic papers are used. As materials for the plastic films, polyolefines such as polyethylene or polypropylene, vinyl-polymers such as polyvinyl acetate, polyvinyl chloride or polystyrene, polyamide such as 6,6-nylon or 6-nylon, polyester such as polyethylene terephthalate or polyethylene-2,6-naphthalate, polycarbonate or cellulose acetate such as cellulose triacetate or cellulose diacetate are used. A typical resin for the resin-coated paper is polyolefin. A gelatin layer is preferably used as a subbing layer on the web. A surface of the resin-coated paper can be a rough surface, not limited to a smooth one.

Figure 1:
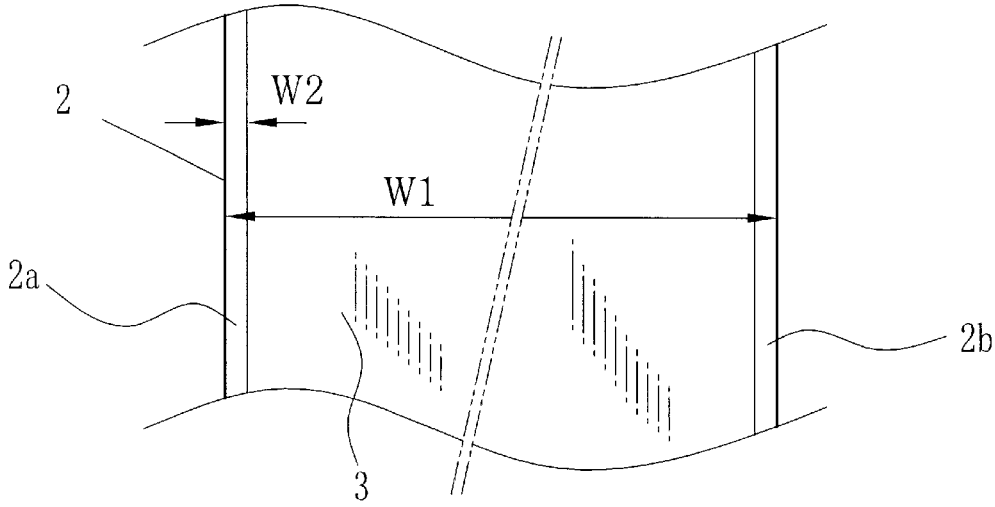
FIG. 1 shows a back surface of the web used in the invention.

FIG. 1 shows a back surface of web used in the invention and FIG. 2 shows sectional views of the web. As shown in FIG. 1, the back side of the web 2 has a subbing layer 3 having a width narrower than the web width W1. Both elongated edge areas 2*a* and 2*b* of widths W2 respectively on the back side of the web 2 have no subbing layer. The back surface subbing layer 3 includes carboxyl group of carboxylic salt, hydrophilic polymer colloidal matter or inorganic colloidal matter, which provides a lower surface resistivity than that of edge areas of the web without the subbing layer.

Materials including a carboxyl group is, for example, a solution formed by hydrolyzing a copolymer of isobutylene and maleic anhydride with alkali such as sodium hydroxide or potassium hydroxide. Isobutylene could be replaced with 1-penten, butylvinylether or styrene. Other materials including a carboxyl group are, for example, copolymer of styrene and itaconic acid, copolymer of styrene and crotonic acid or copolymer of methylacrylate and citraconic acid. A copolymer of those above-mentioned copolymers, or a salt from those copolymers can also be used in this invention. Water-soluble polymer compounds including sulfone group are, for example, polystyrene sulfonic acid, polyvinyl benzilsulfonic acid or sodium or potassium salt of them. Carboxylic denatured polyethylene or salt thereof is an example of hydrophilic polymer colloidal matter. Colloidal alumina is a typical example of an inorganic colloidal.

In the case where the width W1 of the web is between 1 and 5 m, the width W2 of each of elongated edge areas 2*a* and 2*b* where there is no subbing layer should be between 1 and 50 mm and more preferably between 1 and 30 mm. The back surface subbing layer can be formed by other methods than coating, such as lamination. Any material can be used as the subbing layer as long as it can make surface resistivity lower than that of the web itself (without the subbing layer). Thus, the back surface subbing layer of which width is narrower than that of web 2 makes surface resistivity of edge areas 2*a* and 2*b* relatively higher (precise resistivity of edge areas remains unchanged), which leads to lower leakage of charge from the edge areas. This improves uniformity of charge distribution on the web including edge areas and results in stable coating including the edge area.

Figure 2A:
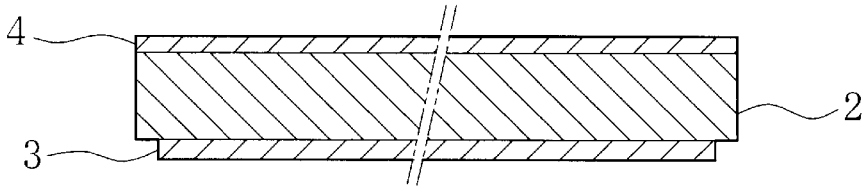
FIG. 2A shows a sectional view of the web shown in FIG. 1.
Figure 2B:
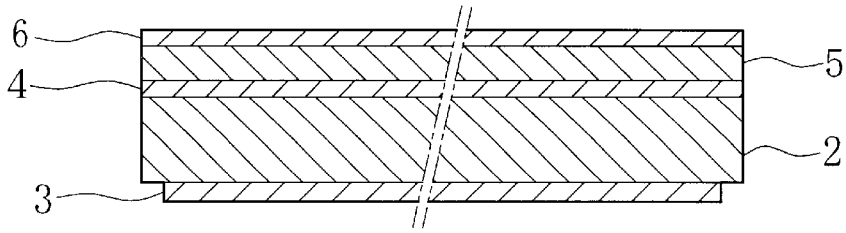
FIG. 2B shows a sectional view of photographic film using the web shown in FIG. 1.
Figure 3:
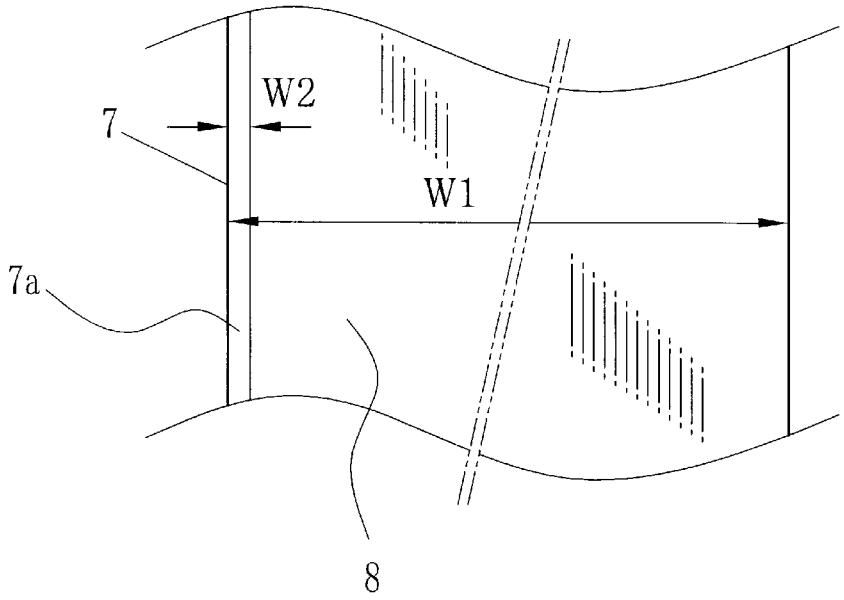
FIG. 3 shows another type of back surface of the web used in the invention.
Figure 4A:
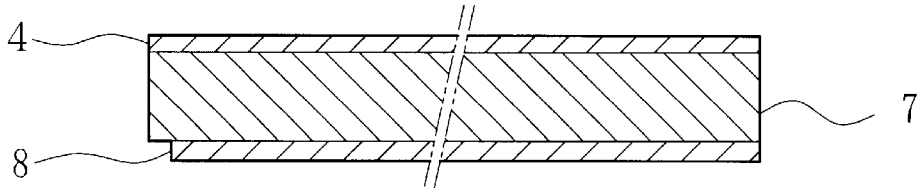
FIG. 4A shows a sectional view of the web shown in FIG. 3.
Figure 4B:
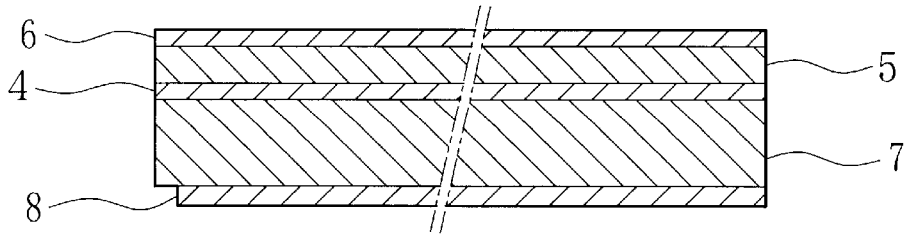
FIG. 4B shows a sectional view of photographic film using the web shown in FIG. 3.

As shown in FIG. 2A, a subbing layer 4 including gelatin is previously formed on the front surface of web 2. A photographic layer 5 and a protective layer 6 shown in FIG. 2B are coated on the web 2 to form a photographic material. FIG. 3 shows a web 7 which lacks a subbing layer 8 at only one side edge area 7*a* on the back surface. The front surface has a subbing layer 4 over the entire width. This type of supporting web is still capable of preventing the web from becoming non-uniform in charge distribution. As shown in FIG. 4A, a subbing layer 4 is previously formed on the front surface of web 7. A photographic layer 5 and a protective layer 6 shown in FIG. 2B are coated on the subbing layer 4 to form a photographic material.

The invention can be used with a variety of coating solutions such as ones for a photographic emulsion layer, a subbing layer, a protective emulsion layer and a back layer for manufacturing photographic materials. Also coating solutions for an adhesive layer, dying layer or antirust layer can be used. Those coating solutions include a water-soluble binder or an organic binder.

Figure 5:
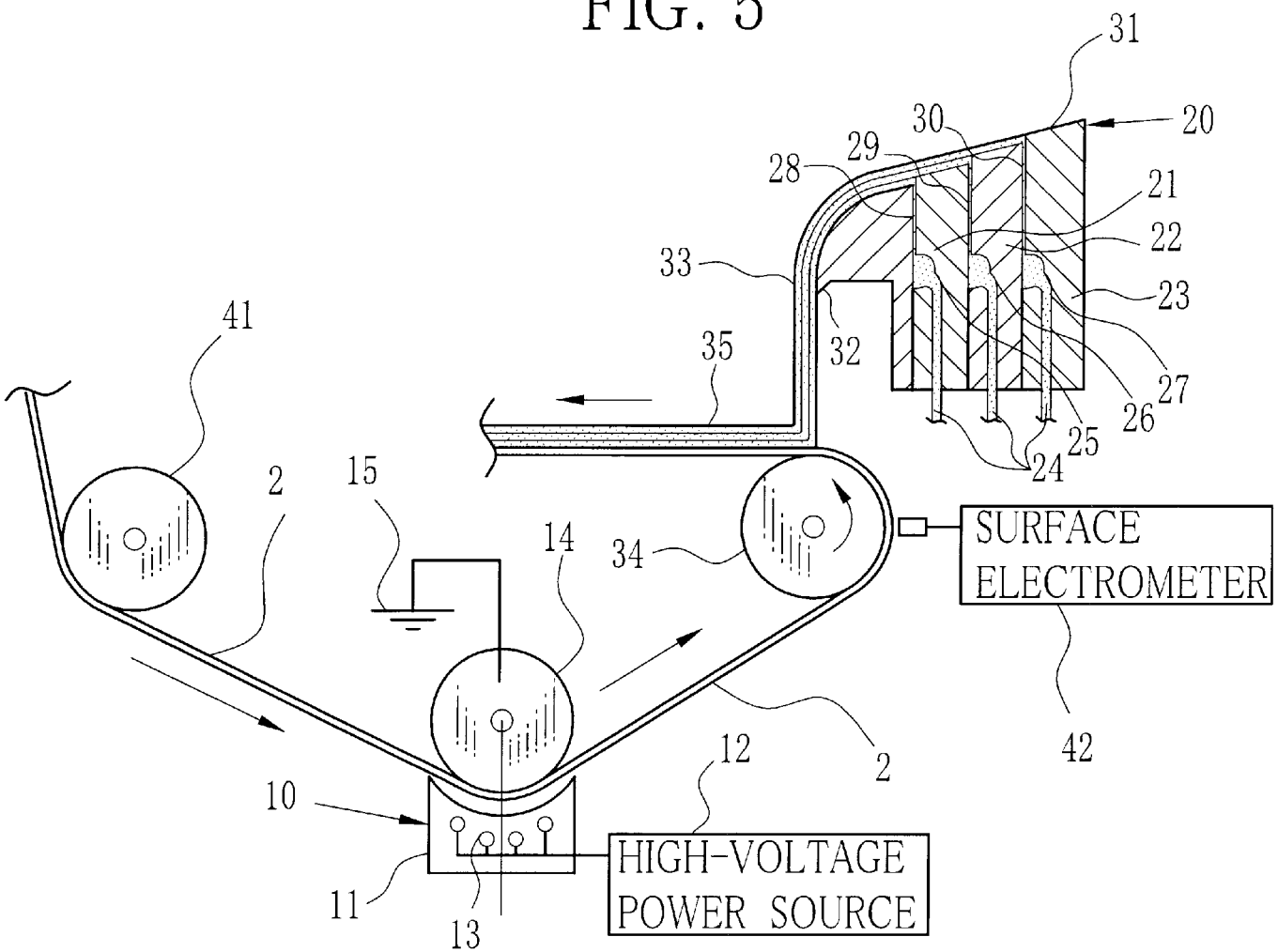
FIG. 5 is a schematic view illustrating a coating station including a curtain coater and electrostatic charging device used for the invention.

As shown in FIG. 5, the surface of a web 2 is coated by a curtain coater 20 after being electrified by an electrostatic charging device 10. The electrostatic charging device 10 includes an electrode supporting frame 11, a high-voltage power source 12, a corona discharging electrode 13 and web transporting roller 14. The roller 14 is grounded by a grounding wire 15. After electrified, the web is coated by a curtain coater 20. The curtain coater used in this embodiment is a so-called multiple slide hopper. The multiple slide hopper 20 is constituted by a plurality of die blocks 21, 22, 23 and a block with lip edge 32 which are secured to each other. The multiple slide hopper 20 has slide surface 31 on its top side downwardly inclined, over which coating liquid flows by gravity.

In the multiple slide hopper 20, the first coating liquid 24*a* is continuously pumped through a feeding tube at a given rate into a cavity 25 from which the liquid is extruded through a narrow vertical slot 28 out onto the downwardly inclined slide surface 21. The cavity 25 and the slot 28 extend across the width of the hopper 20 to cause the coating liquid 24*a* pumped into the cavity 25 to spread out across the hopper 20 and to be forced through the narrow vertical slot 28 in the form of a ribbon of hopper width. Other slots 29 and 30, and cavities 26 and 27 of the multiple slide hopper 20 have the same structure and function. Second coating liquid 24*b* is fed into cavity 26 and third coating liquid 24*c* is fed into a cavity 27. The second coating liquid 24*b* is superimposed on the first coating liquid 24*a* while flowing down the inclined slide surface and likewise the third coating liquid 24*c* is superimposed on the second coating liquid 24*b*. Those superimposed layers flow down without mixing with each other and form a free-falling curtain 33 after leaving the lip edge 32 which impinges on the running web 2 backed by the backing roller 34 to form coated layer 35.

Surface potential of the front surface (to be coated) of the web is measured by a surface electrometer 42 while the web is backed by the roller 34. Curtain coating is used in this embodiment, however, the invention is applicable to other types of coating such as roller bead coating, slide bead coating, extrusion coating or spray coating.

EXAMPLE

A polyethylene resin coated paper of 220 $\mu$m thickness was used as a web. A coating side (front side) of the web has a gelatin subbing layer with a dry thickness of 0.06 $\mu$m. The back surface of the web except at the edge areas is covered with a back surface subbing layer including an inorganic anti-static agent. Width W2 of each edge area 2*a*, 2*b* was 5 mm respectively. This web was sample 1. Web of sample 2 has a full width subbing layer on the back. A surface resistivity of the subbing layer was $10^9\Omega$ and that of web without the subbing layer (in the edge area) was $10^{16}\Omega$.

A coating test was carried out by simultaneous three-layer coating. The coating solution for lowermost layer was made of 10 weight % aqueous solution of alkali treated gelatin, 0.15 weight % aqueous solution of sodium dodecylbenzenesulfonate and some amount of sodium polystyrenesulfonate to increase viscosity up to 40 cp. The coating solution for the intermeidate layer was made of 10 weight % aqueous solution of alkali treated gelatin, 0.05 weight % aqueous solution of sodium dodecylbenzenesulfonate and some amount of sodium polystyrenesulfonate to increase viscosity up to 70 cp. The coating solution for the uppermost layer was made of 10 weight % aqueous solution of alkali treated gelatin, 0.15 weight % aqueous solution of sodium dodecylbenzenesulfonate and some amount of sodium polystyrenesulfonate to increase viscosity up to 20 cp.

Sample 1 web ran at a speed of 400 m/mm. Initially a voltage of 7.5 kv was applied to electrodes of a charging device 10 to form unipolar charge on the web. Then the applied voltage was gradually reduced to determine a lower limit of voltage to keep stable coating where the edge areas of the web can be normally coated. The charging device 10 was connected to a DC constant-voltage power source Model664 made by TREK, INC. Then simultaneous three-layer coating was carried out by using curtain coater 20. Each flow rate of three layers through the slot of multi-coating hopper of the curtain coater 20 is 1.25 cc/cms for the lowermost layer, 2.5 cc/cms for the intermediate layer and 1.25 cc/cms. Between the backing roller 34 and the charging device 10 are five web transporting rollers (not shown) contacting the front surface (to be coated) of the web and one web transporting roller (not shown) contacting the back surface. Sample 2 web was also tested in the same manner as for sample 1.

In an examination of the sample 1, the voltage of the charge device is gradually decreased in order to know the largeness of a limit voltage under which stable coating is difficult. The limit voltage of the sample 1 was 5.5 kV. The sample 2 is examined in the same way as the sample 1. The limit voltage of the sample 2 was 5.6 kV. This shows that sample 2 web requires slightly higher voltage to obtain same level of coating stability than sample 1 web.

In the same tests, surface potential of each web was also measured under the condition that voltage of 7 kV was applied to the electrodes to make corona discharge. Surface potentials of the edge area (at a point 1 cm away from the edge of web) and of the center area of the web were measured by surface electrometer(electrostatic voltmeter), Model 334 made by TREK, INC. The reason 7 kV was selected is that 7 kV is sufficient value to keep stable coating against disturbance such as passing of a spliced portion of a continuous web, although 5–6 kV was a limit value to maintain a stable coating.

TABLE 1 shows the surface potentials of each of samples 1 and 2.

TABLE 1

| | Edge area potential | Central area potential |
|---|---|---|
| Sample 1 | 1500 V | 1800 V |
| Sample 2 | 1200 V | 1800 V |

Edge area potential of sample 1 is higher than that of sample 2, which indicates charge leakage from edge area in sample 1 is lower than that in sample 2. In other words, sample 1 has less non-uniform distribution of charge than sample 2. Thus it is understood that a web having a back surface with a higher resistivity in the edge area than that in the central area is useful for stable coating using an electrified web. One of the easy ways to provide a higher surface resistivity at either both edge areas or one edge area is to apply a subbing layer to the web while leaving the edge area free of the subbing layer.

It is to be understood that the above-described embodiments are simply of the invention. Other embodiments may be devised by those skilled in the art which will embody the principal of the invention and fall whithin the sprit and scope thereof.

What we claim is:

1. A method for coating web comprising the steps of:

(a) applying a coating to a central area of a back surface of a web so that at least one of two longitudinal edge areas of said back surface is free of coating and has a higher surface resistivity than the central area of said back surface, said central area being located intermediate said longitudinal areas;

(b) after step (a), advancing said web to pass by a coating station;

(c) electrifying said web upstream from said coating station; and (d) coating a front side of said electrified web at said coating station.

2. A method according to claim 1, wherein said applying a coating to the back surface step comprises applying a subbing layer to said web back surface so as to leave said at least one edge area free of said subbing layer.

3. A method according to claim 1, wherein a curtain coating is used for coating said electrified web at said coating station.

4. A method according to claim 1, wherein a surface voltage of said central area of said back surface is more than 1800 V.

5. A method according to claim 1, wherein surface resistivity of said at least one edge area is $10^{16}\Omega$.

6. A method according to claim 1, wherein a width of said at least one edge area having the higher surface resistivity is between 1 and 50 mm.

7. The method of claim 2, wherein the surface resistivity of the at least one edge area is $10^7$ times higher than the surface resistivity of the subbing layer.

8. A method of assuring a uniform charge distribution on a web front side at a time of web coating, comprising the steps of:

prior to applying a electrostatic charge to a web front side and then applying a product coating on the web front side, applying a subbing layer to a central area on a back side of the web, the subbing layer not be applied to at least one back side lateral edge of the web so that a width of the at least one back side lateral edge remaining free of the subbing layer is sized to provide the at least one back side lateral edge with a higher surface resistivity than a surface resistivity of the central area, the width of the at least one back side lateral edge remaining free of the subbing layer being selected to provide a corresponding lateral edge area of the web front side able to accept and maintain a uniform electrostatic charge with respect to a remainder of a front area of the web during transport over rollers to a coating station.

9. The method of claim 8, wherein two lateral back side edges of the web remain free of the subbing layer.

10. The method of claim 8, comprising the further steps of:

uniformly electrifying the web front side at a web electrifying station;

transporting the web from the electrifying station to a coating station over transporting rollers with the back side of the web contacting the transporting rollers, the transporting rollers causing charge discharge from the electrified web having the at least one back side lateral edge free of the subbing layers; and coating a front side of the web at the coating station.

11. The method of claim 8, wherein the subbing layer is a gelatin layer.

12. The method of claim 8, wherein the web is a paper material.

13. The method of claim 8, wherein the web is a plastic film material.

14. The method of claim 9, wherein the step of applying the subbing layer to the central area on the web back side but not to the two back side lateral edges of the web, applies a subbing layer comprising one of the group consisting of a carboxyl group, a carboxylic salt, a hydrophilic polymer colloid, and an inorganic colloid.

15. The method of claim 9, wherein, the web has a width between 1 and 5 meters, and the back side lateral edges each have a width between 1 and 50 mm.

16. The method of claim 15, wherein the back side lateral edges each have a width between 1 and 30 mm.

17. The method of claim 10, wherein the step of coating the front side of the web at the coating station provides a photographic emulsion layer on the web.

18. A method of obtaining and maintaining a uniform charge distribution on a web that is to be subsequently coated with a product layer, comprising the sequential steps of:

a) coating a web on a back side to provide a subbing layer having a width less than a width of the web, a least one lateral edge of the back side remaining subbing layer coating free and having a surface resistivity higher than a surface resistivity of the subbing layer;

b) uniformly electrifying the web on a front side to be coated with the product layer at a web electrifying station;

c) transporting the web from the electrifying station to a coating station while having the back side of the web contacting transporting rollers, wherein the subbing layer prevents charge leakage from the front side of the electrified web to the transporting rollers.

19. The method of claim 18, wherein, a polyethylene resin coated paper is used as the web, the subbing layer comprises an inorganic anti-static layer, and the least one lateral edge of the back side remaining subbing layer coating free has a surface resistivity $10^7$ times higher than the surface resistivity of the subbing layer.

* * * * *